US005538449A

United States Patent [19]

Richard

[11] Patent Number: 5,538,449

[45] **Date of Patent: *Jul. 23, 1996**

[54] BOAT TROLLING VALVE SAFETY DEVICE

[76] Inventor: Andre L. Richard, 741 Kanuga Dr., West Palm Beach, Fla. 33402

[ * ] Notice: The term of this patent shall not extend beyond the expiration date of Pat. No. 5,368,510.

[21] Appl. No.: 346,004

[22] Filed: Nov. 29, 1994

Related U.S. Application Data

[63] Continuation-in-part of Ser. No. 75,296, Jun. 11, 1993, Pat. No. 5,368,510.

[51] Int. Cl.[6] ..... B63H 21/22

[52] U.S. Cl. ..... 440/1; 440/84; 440/86; 440/87

[58] Field of Search ..... 440/75, 1, 2, 84, 440/86, 87, 900, 113; 114/145 R, 255; 192/87.19, 101, 82 R, 30 W, 129 A; 74/DIG. 8, 473 R, 480 B, 501 R, 501.6, 109; 340/686

[56] References Cited

U.S. PATENT DOCUMENTS 2,785,584 3/1957 Hambleton ..... 440/87
3,823,801 7/1974 Arnold ..... 192/87.19
3,938,637 2/1976 Murakami ..... 192/87.19
4,836,809 6/1989 Pelligrino ..... 440/84
5,368,510 11/1994 Richard ..... 440/86

*Primary Examiner*—Edwin L. Swinehart
*Attorney, Agent, or Firm*—Quarles & Brady

[57] ABSTRACT

A trolling valve safety device that locks or limits actuation of a boat engine throttle from its idle position during use of a trolling valve, and vice versa, preferably includes a rotating control plate having mounts for throttle cables so that throttle actuation requires plate rotation. This rotation can be limited by a cam slider which slides under force of trolling valve control cables and provides a cam member that inserts in control slots of the control plate. The cam member is positioned in a locking radial slot when the trolling valve is engaged and thereby locks or limits engine throttling. The cam member is positioned in a releasing arcuate position when the trolling valve is disengaged and thereby permits rotation of the plate and associated engine throttling. A stop pin can also extend from the plate to selectively permit or limit rotation of the plate by alignment or disalignment with a groove in the cam slider and can be adjustable to permit slight throttling during trolling valve use. A series of switches can also be provided to coordinate various engine safety devices and controls with the condition of the trolling valve and the throttle of the engine.

17 Claims, 10 Drawing Sheets

10
82
108
26
28
40
70
104
106
100
86
92
50
96
114
46
42
94
90
52
54
57
76
72
56
74
60
112
98
113
48
68
78
80
110
84
67
66
64
44
140
58
62
38
101
102
103

BOAT TROLLING VALVE SAFETY DEVICE

CROSS-REFERENCE TO RELATED APPLICATIONS

This is a continuation-in-part of U.S. patent application Ser. No. 08/075,296, filed Jun. 11, 1993, now U.S. Pat. No. 5,368,510.

FIELD OF THE INVENTION

The present invention relates generally to boat engine control equipment. More particularly, the invention relates to apparatus for controlling boat engine fuel throttles and trolling valves.

BACKGROUND OF THE INVENTION

The engine fuel throttle of a marine engine and the associated speed of the boat are typically controlled by a throttle lever at the helm of the boat. The helm throttle lever typically manipulates the engine throttle assembly through cabling, either mechanically or electromechanically.

The engine controls can also include a clutch control lever that controls the clutch assembly in the marine transmission. The clutch assembly includes clutch plates which are forced together by high fluid pressure to transmit engine power through the transmission to the propeller drive train.

In some boats, the engine controls further include a trolling valve, that relieves varying levels of the fluid pressure that releases and compresses the clutch plates and allows slippage in the power transmission through the marine transmission to the propeller drive train. By manipulating the trolling valve, the idle speed of the boat in water can be adjusted from a normal idle speed of four to seven knots down to perhaps one knot to enhance fishing conditions and the like.

Use of the trolling valve, however, presents a significant danger of marine transmission clutch plate assembly damage. The typically high oil pressure and associated oil circulation rate inside the marine transmission during normal operation transfers a significant amount of heat generated by the marine transmission clutch plate assembly through a heat exchanger that is cooled by raw water. However, when the pressure is reduced using a trolling valve, the flow rate is reduced, and the marine transmission clutch plates can overheat as a result of inadequate heat dissipation when the engine is revved above factory limits during use of the trolling valve.

SUMMARY OF THE INVENTION

It is an object of the invention to provide a system to limit marine transmission clutch plate assembly damage when using a trolling valve.

It is another object of the invention to provide a marine transmission protection system that is rugged and reliable in marine environments.

It is yet another object of the invention to provide a marine transmission protection system that can readily be retrofitted to an existing engine control system.

It is still another object of the invention to provide a marine transmission protection system that can provide its function mechanically or electromechanically.

These and other objects are achieved by a trolling valve safety device that automatically locks or limits actuation of the engine throttle from its idle position when the marine transmission trolling valve is engaged, and vice versa. The trolling valve safety device includes means for releasably limiting actuation of the engine throttle and means for locking the limiting means when the trolling valve is engaged and releasing the limiting means when the trolling valve is disengaged. The limiting means preferably prevents actuation of the throttle from its idle position, except for relatively minor variations in motion due to cable play and part gap tolerances. The invention also provides an optional configuration in which the limiting means permits throttling through a predetermined range from idle when the trolling valve is open. It is, however, within the intended scope of the invention that the limiting means limits actuation of the throttle during trolling valve use to a level below the threshold for marine transmission clutch plate assembly burnout.

The trolling valve safety device preferably includes a circular control plate rotatably mounted on a support, which is preferably secured to the boat structure in the engine compartment. The control plate provides cable pivot mounts for connecting cables that control the engine throttle assembly. One cable connects to the engine throttle assembly, and the other connects to the throttle control at the helm. The mounts are preferably diametrically opposed so that actuation of the engine throttle through the cables requires rotation of the control plate.

The engine throttle actuation can thus be controlled by limiting rotation of the control plate as a function of the operational status of the trolling valve. Preferably, the status of the trolling valve is coordinated with the locking of the control plate by the interaction of a cam member that slides in a slot formed in the control plate. The cam member is preferably mounted on a cam slider that slides the cam member in and out of a plate locking position as the cam slider is actuated by the control cables for the trolling valve.

The control slot in the control plate preferably includes a releasing arcuate section about the rotational axis of the control plate and a locking radial section extending from an end of the arcuate section toward the axis. The cam member travels in the control slot and is rotationally fixed relative to the support. Thus, positioning of the cam member in the arcuate portion of the slot permits rotation of the control plate while positioning of the cam member in the radial slot blocks rotation.

The cam member is preferably mounted on a cam slider that is rotationally fixed relative to the support base. The cam slider interconnects the control cables for the trolling valve. As the cables move, the cam slider moves. To coordinate the idle position of the engine throttle with the actuation of the trolling valve, the cam slider and the cam member can be positioned relative to the control plate so that the cam member aligns with the locking radial portion of the slot when the engine throttle is idling.

When the cam member is located in the releasing arcuate section, the control plate is free to rotate and permit actuation of the engine throttle. Correspondingly, the cam slider cannot slide when the cam member is in the arcuate portion and thereby limits actuation of the trolling valve.

When the cam member is located in the locking radial slot, sliding of the cam slider and associated actuation of the trolling valve is possible, but the rotation of the control plate and the associated actuation of the engine throttle is locked or limited.

The locking means can include a stop pin extending from the control plate for engagement with the cam slider. The cam slider can provide a groove that aligns with the stop pin to allow rotation of the plate when throttling is to be permitted. The cam slider can be moved with actuation of the trolling valve controls to disalign the channel with the stop pin to prevent rotation of the plate when throttling is to be limited. The locking pin can be adjustably positioned on the control plate to permit limited rotation of the control plate even when disaligned with the cam slider. In this manner, limited throttling can be permitted when the trolling valve is actuated.

The cam slider can be controlled by control cables for the trolling valve. Alternatively, an electromechanical actuator can move the cam slider and the cable to the trolling valve in response to a signal from the boat trolling valve control.

The device can also provide a system for actuating a variety of switches to control different alarms, indicator lights, actuators, safety and limit switches and other components as a function of trolling valve or throttle condition. The condition of the trolling valve or the engine throttle can be coordinated with various switches by their position relative to control slots on the periphery of the control plate or the end of the sliding locking means.

Thus, the present invention provides an automatic system for avoiding, or at least limiting, the potentially damaging use of a boat engine throttle while using a trolling valve, and vice versa.

BRIEF DESCRIPTION OF THE DRAWINGS

A more detailed understanding of the invention and its preferred embodiments can be gained from a reading of the following description in connection with the accompanying drawings, in which.

DESCRIPTION OF THE PREFERRED EMBODIMENTS

Figure 1:
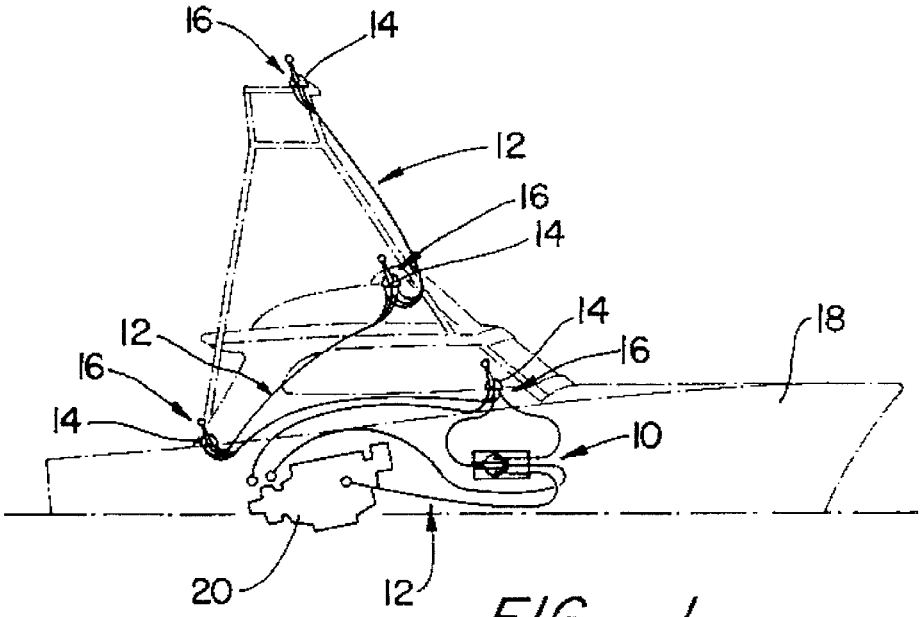
FIG. 1 is an illustration of an overall placement of a boat engine control system utilizing the trolling valve safety device.

The present invention is directed to marine equipment for reducing the likelihood of marine transmission clutch plate assembly burnout during use of a trolling valve on the marine transmission. Referring to the figures, and particularly FIG. 1, a trolling valve safety device 10 is preferably installed along the control cable lines 12 between the engine controls 14, located at the various stations 16 on a boat and the boat engine 20. The trolling valve safety device 10 can be entirely mechanical in operation or can be electromechanical.

Figure 2:
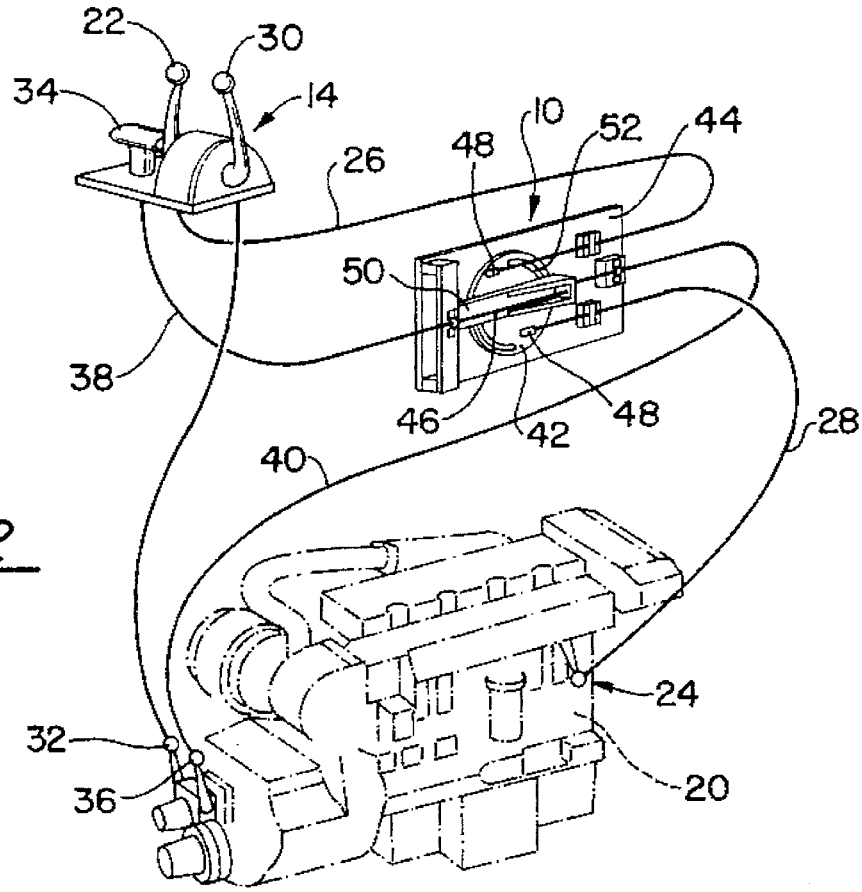
FIG. 2 is a perspective view of a boat engine control system that includes a preferred embodiment of the trolling valve safety device.

Referring to FIG. 2, the engine controls 14 can include a throttle control lever 22 for actuating the engine fuel throttle assembly 24 through throttle control cables 26, 28. The engine controls 14 can also include a clutch control lever 30 directly cabled to the engine clutch assembly 32. The engine controls 14 can further include a trolling valve control 34, which actuates a trolling valve assembly 36 on the marine transmission (not shown) to adjust the pressure of the oil that compresses the marine transmission's clutch plates, thereby varying the engine drive output and associated boat trolling speed.

The trolling valve safety device 10 serves as a control junction for the control cables 26, 28 extending from the throttle control lever 22 to the engine throttle assembly 24 and for trolling valve control cables 38, 40 extending from the trolling valve control 34 to the trolling valve 36. The trolling valve safety device 10 generally includes means for releasably limiting actuation of the engine throttle when the trolling valve is engaged and means for locking the limiting means when the trolling valve is engaged or actuated and releasing the limiting means when the trolling valve is disengaged.

The limiting means preferably prevents actuation of the throttle from its idle position, except for relatively minor variations in motion due to cable play and part gap tolerances. It is, however, within the intended scope of the invention that the limiting means limits actuation of the throttle during trolling valve use to a level below the threshold for marine transmission clutch plate assembly burnout. When released, the limiting means does not restrict throttling.

As used herein, preventing refers to a limiting of significant motion of the throttle assembly during use of the trolling valve and limiting of significant motion of the trolling valve during use of the throttle. Play in control cables and variations in parts due to manufacturing tolerances can permit some actuation motion to occur despite locking by the structure of the invention. Such play motion is considered negligible if the associated engine RPM levels are below the threshold for marine transmission clutch plate assembly burnout for that particular installation. In some environments, one quarter of maximum throttle may correspond to the engine level limit while others may be significantly less or significantly higher, to as much as one half of maximum throttle. The particular threshold to avoid marine transmission clutch plate assembly burnout on a particular boat can typically be found from the manufacturer of the marine transmission.

The limiting means preferably includes a throttle control plate 42 rotatably mounted on a support 44 for rotation relative to the support 44 about a central pivot axis 46. The control plate 42 is preferably circular and made of aluminum, but can be constructed in other geometries and materials capable of rotating relative to the support 44, which is preferably a mounting plate made of aluminum and can otherwise be provided by structure suitable for mounting to the framework of a boat engine compartment.

The preferred throttle control plate 42 provides cable mounts 48 for connection to the throttle control cables 26, 28. One cable 26 is connected at its opposite end to the throttle control lever 22, and the other cable 28 is connected to the engine throttle assembly 24. The cable mounts 48 are preferably diametrically opposed on the control plate 42 so that actuation of the throttle assembly 24 by the throttle control lever 22 through the throttle control cables 26, 28 requires rotation of the control plate 42.

The means for locking the control plate 42 against rotation, and thereby limiting throttle actuation, operates as a function of the operational status of the trolling valve 36. Preferably, the means for locking and releasing the control plate 42 utilizes the interaction of at least one cam slider 50 that slides in conjunction with trolling valve actuation in a control slot 52 formed in the control plate 42 to either permit or prevent rotation of the control plate 42, depending on the relative location of the cam slider 50. The cam slider 50 is slidingly mounted to the control plate 42 and is moved by the actuation of the trolling valve control cables 38, 40.

Figure 3:
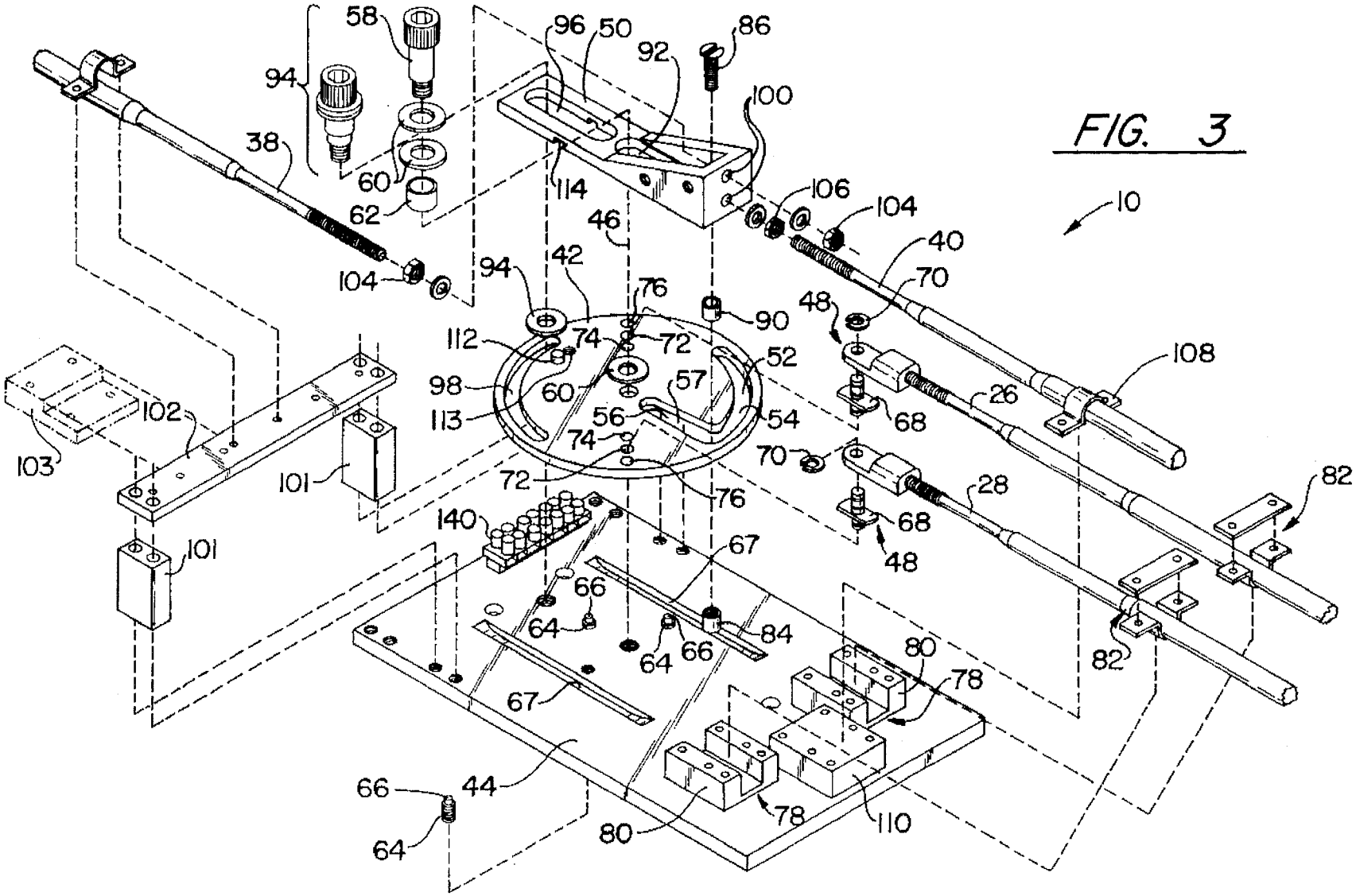
FIG. 3 is an exploded perspective view of a mechanical embodiment of the trolling valve safety device.

Referring to FIG. 3, the trolling valve safety device 10 can be constructed to operate solely on mechanical input and output through the throttle control cables 26, 28 and the trolling valve control cables 38, 40. The control slot 52 includes a releasing arcuate slot 54 about the central pivot axis 46. The arc of the arcuate slot 54 can range in angle depending on the amount of rotation of the control plate 42 required. The control plate rotation is in turn dependent on the length of motion in the throttle control cables 26, 28. Preferably, the arc is approximately 62 degrees to correspond to the rotational motion associated with a standard 3 inch motion of the throttle control cables 26, 28. At one end of the slot arc, the control slot 52 transitions to a locking radial slot 56 extending toward the central pivot axis 46.

In a preferred embodiment, the control plate 42 is pivotally mounted to the support 44 by a central shoulder bolt 58 and washers 60, and the bolt 58 is surrounded by a Delrin bearing sleeve 62 to facilitate rotation. A series of set screws 64 are inserted from the bottom of the support 44 and provide Delrin tips 66 to slidingly engage the bottom of the control plate 42. The set screws 64 are adjustable to adjust the tilt play of the plate 42.

The support 44 can provide machined slots 67 that serve as channels for fiber glass sleeves (not shown) through which wiring for various switches can run to avoid chaffing and tangling and to provide a neater environment for repairs, adjustments and other access to the device 10.

The control plate 42 permits actuation of the engine throttle assembly 24 through rotation. The throttle control cable 26 from the throttle control at the helm (not shown) is mounted diametrically opposite the throttle control cable 28 to the engine throttle assembly (not shown) so that transmission of the cable motion occurs through rotation of the control plate 42.

The throttle control cables 26, 28 are each preferably mounted on a cable mount post 68 and secured by a clip 70. According to one aspect of the invention, the control plate 42 can provide a plurality of post mount holes so that the relative position of the cable mount posts 68 to the central pivot axis 46 can be varied. The central mount holes 72 are preferably spaced equidistantly about 3 inches from the central pivot axis 46. The inner holes 74 and the outer holes 76 can be positioned approximately ⅜ inch radially away from the central holes 72. In this way, the sensitivity of the throttle control can be adjusted to suit the particularly needs and desires of the user. For example, the sensitivity of the throttle control can be increased by mounting the throttle control cable 28 from the throttle control to an inner hole 74 while the throttle control cable 28 to the throttle assembly is mounted on an outer hole. Through rotation of the control plate, a unit of liner motion of the control cable from the throttle control lever results in greater than a unit of linear motion in the control cable and the attached throttle assembly.

The throttle control cables 26, 28 can be securely positioned relative to the support 44 by adjustable cable mounting assemblies which preferably include mounting blocks 80 and clamps 82 that can be adjustably positioned along the mounting blocks 80 to accommodate varying cable rod lengths that may be presented by existing cables on the boat on which the trolling valve safety device 10 is installed.

To lock and release the control plate 42 as a function of the operational status of the trolling valve, a cam member 84 is selectively positioned in either the releasing arcuate slot 54 or the locking radial slot 56. The positioning of the cam member 84 can be linked to the status of the trolling valve by mounting the cam member 84 to the cam slider 50, which slides when the trolling valve is actuated by the trolling valve control cables 38, 40. The cam slider 50 is slidingly mounted on the control plate 42 but is rotational fixed relative to the support 44. The cam slider 50 links the trolling valve control cable 38 from the trolling valve control at the helm (not shown) to the trolling valve control cable 40 connected to the trolling valve on the marine transmission (not shown) and is slid in its travel path by actuating motion of the trolling valve control cables 38, 40.

The cam member 84 can be mounted to the cam slider 50 by a machine screw bolt 86 and is preferably surrounded by a Delrin bearing 90 to facilitate sliding in the control slot 52. The cam slider 50 can be secured to the control plate 42 by the central bolt 58, but is free to slide relative to the central bolt 58. The Delrin bearing sleeve 62 is therefore preferably positioned around the shaft of the central bolt 58 to slidingly engage a slot 92 in the cam slider 50.

The cam slider 50 preferably does not rotate relative to the support 44. A secondary bolt and bearing sleeve assembly 94 preferably mounts through a second slot 96 in the cam slider 50 to the underlying support 44 and prevents rotation of the cam slider 50. This bolt and sleeve assembly 94 also extends through a second slot 98 in the Control plate 42 and can thereby assists in balancing the control plate 42 and its rotation.

The cam slider 50 can provide mounts, such as cable holes 100, for connection to the trolling valve control cables 38, 40. The trolling valve control cable 38 from the trolling valve control at the helm (not shown) can be secured to the support 44 on a mounting bridge 102 that can be positioned on the support 44 through bridge mounting blocks 101. The trolling valve control cable 38 can have a threaded end to secure to the cam slider 50 with a nut 104. The other trolling valve control cable 40 to the trolling valve assembly (not shown) can similarly connect with nuts 106 and mount on the support 44 through a clamp 108 and an adjustable mounting block 110. Alternatively, a cable mounting adaptor 103 can be provided to accommodate different cable configurations, such as a push-to-open trolling valve cable (see FIG. 15), in which is the trolling valve is opened by a pushing of the cable line away from the device 10. This cable 41 would substitute for the pull-to-open cable 40.

The means for locking can include a stop pin 112 extending upwardly from the control plate 42. When the trolling valve is disengaged, the cam slider 50 is preferably positioned relative to the control plate 42 so that a curved channel 114 aligns with the stop pin 112. When the control plate 42 rotates, the stop pin 112 passes through the channel 114. However, when the trolling valve is engaged, the cam slider 50 is moved and the channel 114 is not aligned with the stop pin 112. The stop pin 112 engages a side of the cam slider 50 and prevents the control plate 42 from rotating.

The stop pin 112 is located a fixed distance from the pivot axis 46 and provides a constant resisting moment against any turning moment generated by the throttle control cables 26, 28 when the stop pin 112 is disaligned with the channel 114. This constant resisting moment assists in preventing rotation of the plate 42, particularly when the close proximity of the cam member 84 to the pivot axis 46 during trolling valve actuation results in a smaller resisting moment by the cam member 84. Thus, the stop pin 112 and the cam member 84 together to provide a double lock system against rotation of the control plate 42 and throttling during use of the trolling valve.

Depending on the engine type and other factors, the idle condition of the engine when the trolling valve is open may create unacceptable vibrations in the marine transmission. These vibrations can often be corrected by a slight increase in engine speed. Accordingly, the invention also provides an optional configuration in which the limiting means permits throttling through a predetermined range from idle when the trolling valve is open. To allow the slight rotation, the radial slot 56 can be widened on a side 57 at preferably 5° to avoid blockage by the cam member.

To allow for minor throttling during trolling valve use, the control plate 42 can provide a plurality of stop pin adjustment holes 113 to allow repositioning of the stop pin 112, which can be threaded to readily removably attach at the chosen location.

Figure 4:
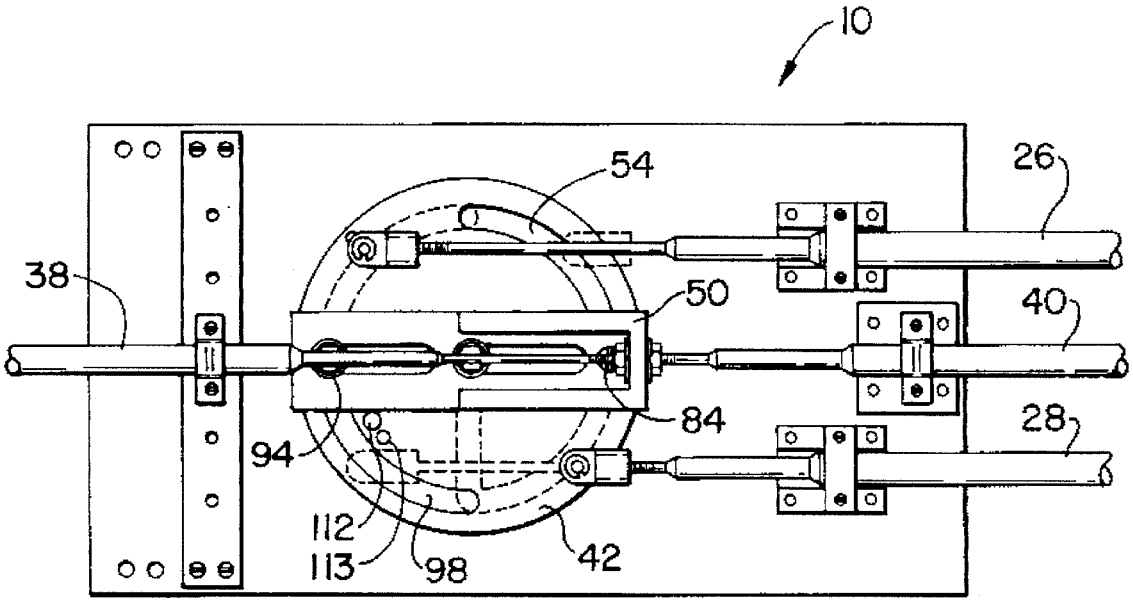
FIG. 4 is a top plan view of an embodiment of the trolling valve safety device in a released configuration.

Referring to FIG. 4, when the trolling valve is not being used, the trolling valve control cables 38, 40 position the cam slider 50 so that the cam member 84 aligns with the releasing arcuate slot 54 and the stop pin 112 aligns with the channel 114, allowing rotation of the control plate 42 and normal throttle operation. The throttle control cables 26, 28 are therefore able to move from the idle position, shown in solid line, to a "full" throttle position, depicted in broken line. The secondary bolt assembly 94 slides freely relative to the secondary slot 98 and does not impede rotation of the control plate 42.

As shown in FIG. 4, the stop pin 112 can be positioned in a non-variable hole to resist any rotational play of the control plate 44 and associated throttling. Alternatively, the stop pin 112 can be removed and inserted in the other variable-speed hole 113 to allow slight rotation of the plate 42 and engine speed variation. In one embodiment, the spacing of the variable speed hole from the edge of the cam slider is about ¼". Accordingly, placement of the stop pin 112 in the variable speed hole 113 permits 3/16", ¼", 5/16" cable movement, depending on the location of the cable mounts in the various control plate mounting holes 72, 74, 76 (see FIG. 3).

Figure 5:
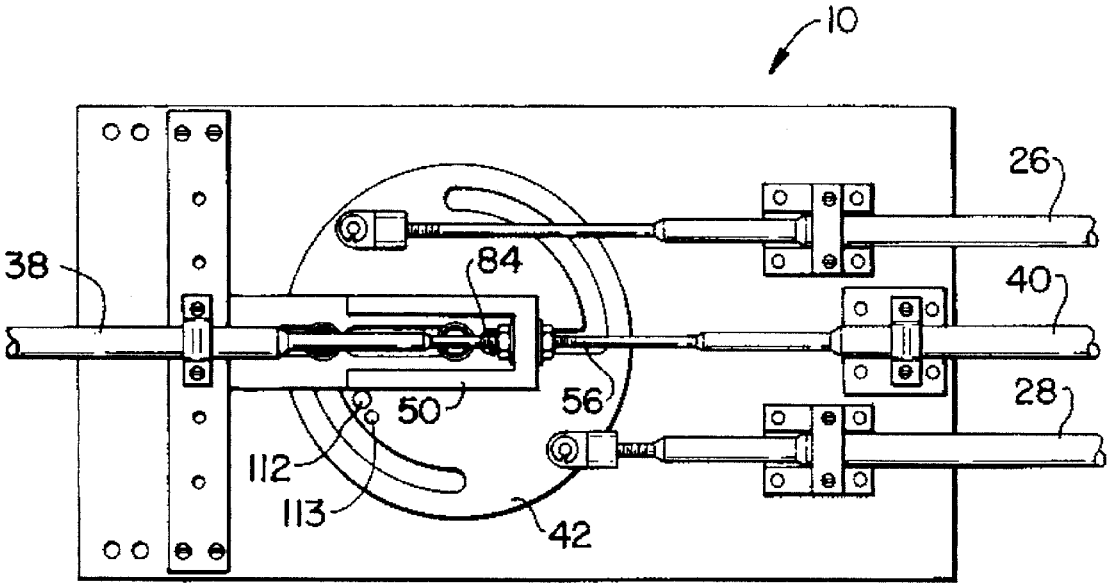
FIG. 5 is a top plan view of an embodiment of the trolling valve safety device in a locked configuration.

Referring to FIG. 5, when the trolling valve is engaged, the cam slider 50 is positioned by the trolling valve control cables 38, 40 so that the cam member 84 is located in the locking radial slot 56. The engagement of the locking radial slot 56 with the cam member 84 prevents rotation of the control plate 42 and associated throttle actuation. Correspondingly, the control cables 26, 28 for the throttle must be in an idle position for the cam member 84 to align with the locking radial slot 56 and permit actuation of the trolling valve.

Figure 6:
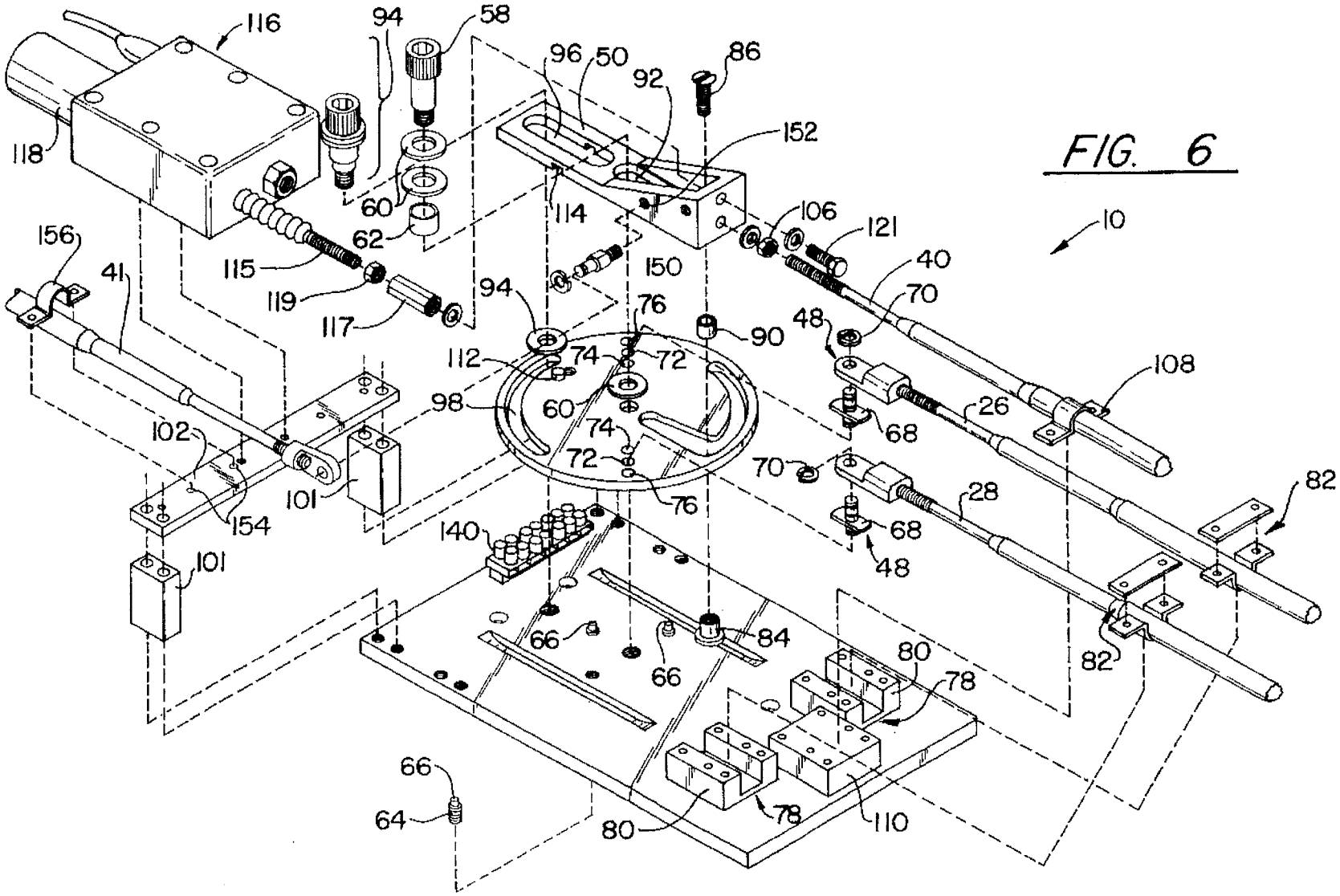
FIG. 6 is an exploded perspective view of an electromechanical embodiment of the trolling valve safety device.

Referring to FIG. 6, the trolling valve safety device 10 can include an electromechanical actuator 116 for the trolling valve. The electromechanical actuator 116 can be of a type known in the art, in which a reversible motor 118 drives an internal cam slider screw drive to advance and retract an internal trolley connected to the cam slider 50. The control rod 115 can be secured to the cam slider 50 by an adjustable threaded sleeve 117 limited by a nut 119 and mounted by a bolt 121. The range of motion of the control rod 115 can be limited by internal trip switches in the actuator 116.

FIG. 6 also illustrates another embodiment of the invention in which cable 41 is provided for a push-to-open trolling valve, which is mounted by a pivot 150 to a side mount hole 152 in the cam slider 50. The mounting bridge 102 can include mounting holes 154 to receive a clamp 156 for the push-to-open cable 41.

Figure 7:
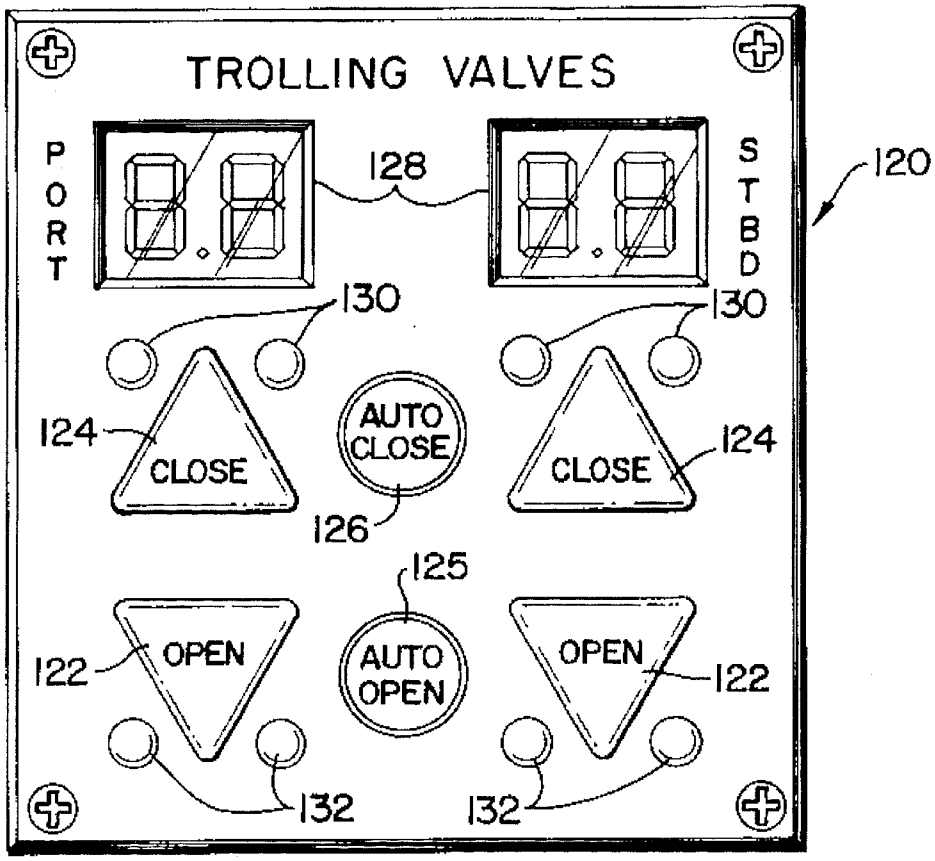
FIG. 7 is a top plan view of a trolling valve control pad for use with the trolling valve safety device.

Referring to FIG. 7, the electromechanical actuator for the trolling valve can be controlled at the helm or other station on the boat by a electronic control pad 120 including touch controls for operating an underlying circuit board. The control pad can include a "close" control 124 and an "open" control 122 for each starboard and port marine transmission trolling valve. The respective controls 122, 124 can be electronically configured to send a signal to either a starboard or port trolling valve safety device electromechanical actuator to correspondingly advance or retract the cam slider and the associated control cable for the appropriate trolling valve. The "open" controls 122 and the "close" controls 124 can be configured to send a signal only so long as they are depressed, thereby enabling variable positioning of the trolling valves and obtaining the associated boat speed. The control pad 120 can further provide an "auto open" control 125 and an "auto close" control 126 for sending a continuous signal to respectively open and close the trolling valves without constant control pad depression.

The control pad 120 Can include digital number displays 128 to indicate the position of the trolling valves along an arbitrary number scale. The displays 128 are preferably LCD. For example, a closed trolling valve could correspond to a reading of 0.0 while a fully open trolling valve position would cause a display of 3.0, with one-tenth increments in between to signify corresponding intermediate positions. To electronically signal the position of the trolling valve to the control pad 120, the actuator (see FIG. 6) can be equipped with a sliding linear potentiometer to emit a signal corresponding to the position of the actuator trolley.

The control pad 120 can also include trolling valve status indicators, such as red LEDs 132, to signify that the trolling valve is engaged and that throttling is prevented, and green LEDs 130, to advise that the trolling valves are closed and that throttling is permitted.

Figure 8:
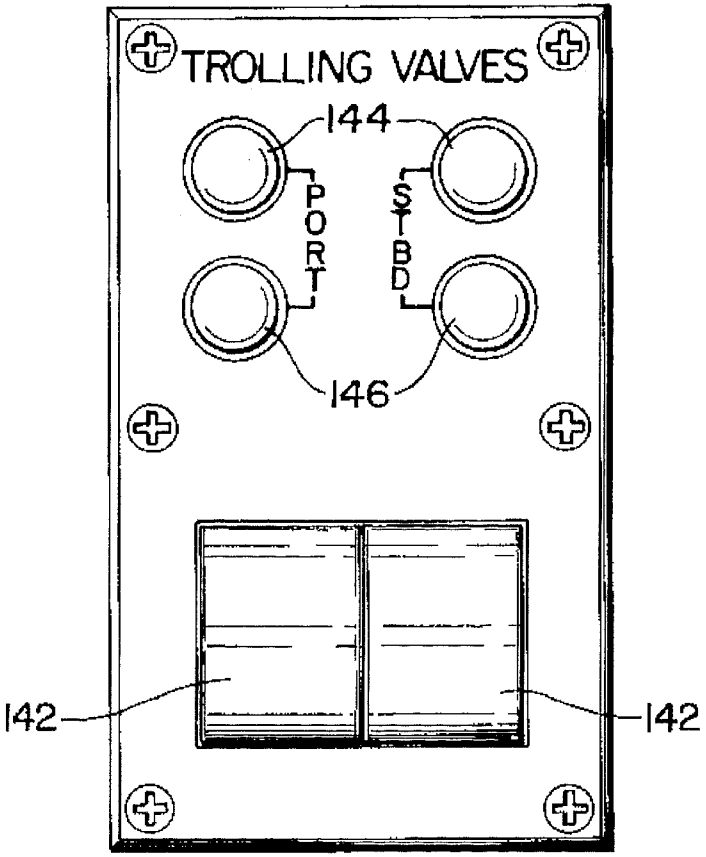
FIG. 8 is a top plan view of an alternative trolling valve control for use with the trolling valve safety device.
Figure 9:
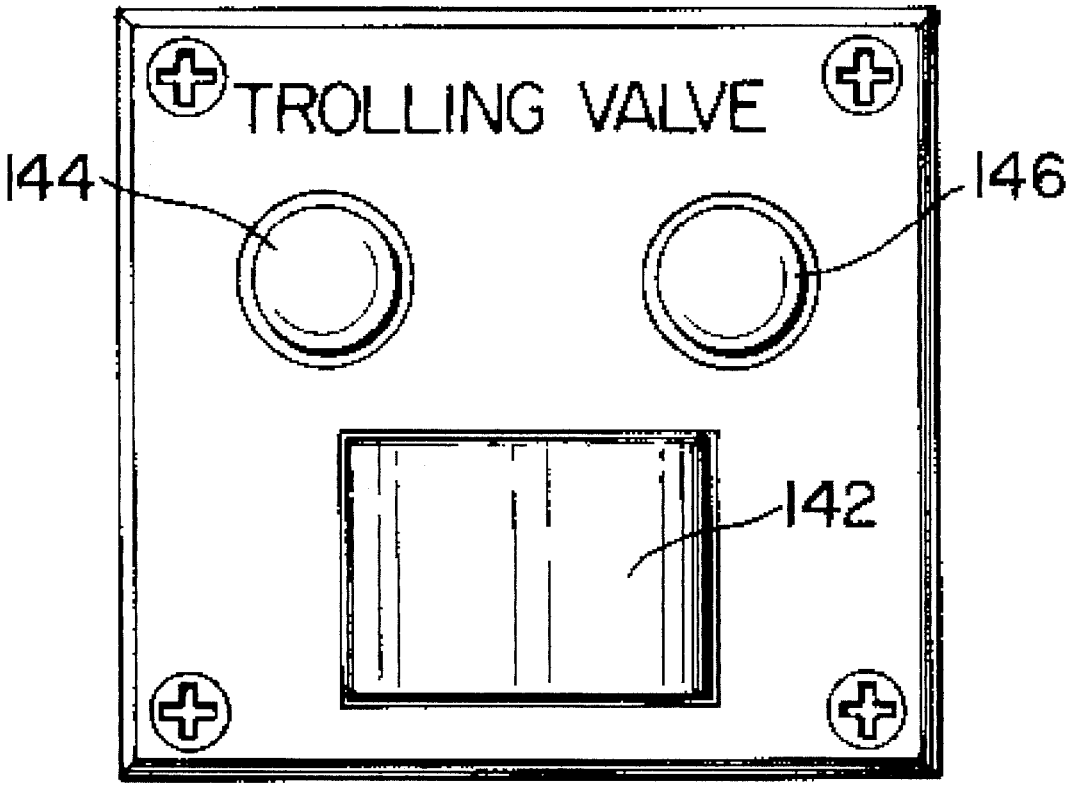
FIG. 9 is a top plan view of another trolling valve control panel for use with a single engine version of the trolling valve safety device.

Referring to FIG. 8, the electromechanical actuator can alternatively be controlled by manual rocker switches 142 directly wired to the actuator. Indicator lamps 144, 146 can advise of the trolling valve status in a manner similar to that discussed above. FIG. 8 represents a control panel for a trolling valve locking system for port and starboard engines. FIG. 9 illustrates a similar control panel for single engine applications. The control panel provides a single rocker switch 142 and indicator lamps 144, 146.

Figure 10:
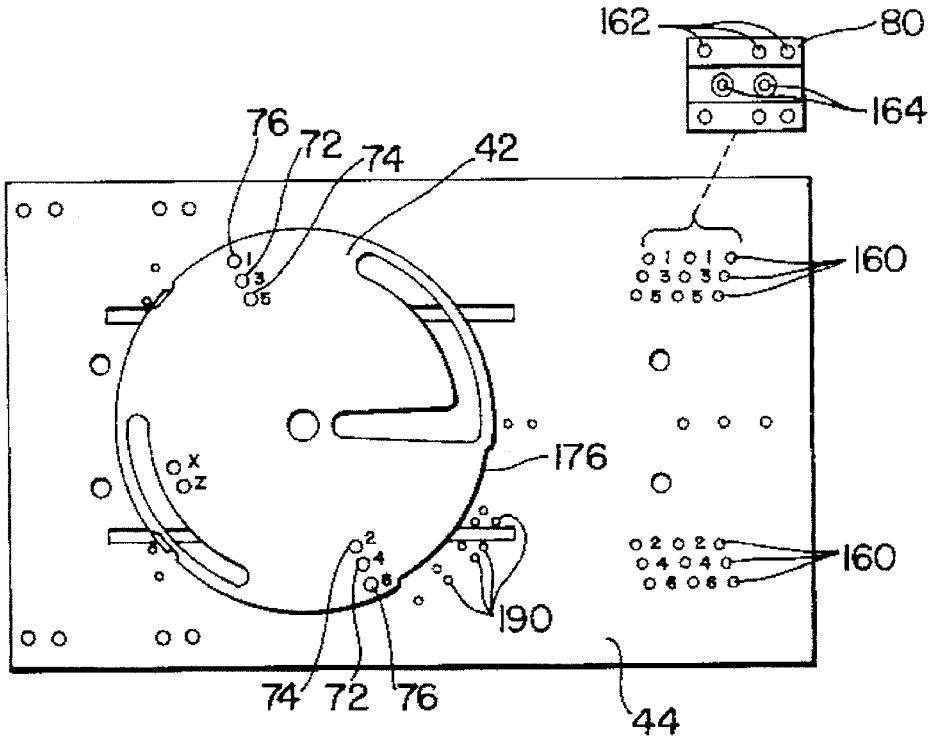
FIG. 10 is a top plan view of a control plate and base support of a preferred embodiment of the trolling valve safety device, showing various mounting holes for attaching a switch system.

Referring to FIG. 10, the cable ends have a limited range of permitted off-axis flex or deflection, usually on the order of 8 degrees. Thus, to maintain proper cable geometry to avoid exceeding this deflection range for the different mounting positions on the control plate 42, the mounting blocks 80 must be capable of mounting indifferent positions. The mounting block 80 can be mounted in a variety of positions to accommodate cable position by securing to a plurality of mounting holes 150 in the support 44 corresponding to the mounting holes 72, 74, 76 in the control plate 42.

The control cables typically have clamp grooves for receiving the securing clamps. The mounting blocks 80 can provide a number of clamp mounting holes 162 to accommodate a variety of clamp groove configurations. To facilitate adjustment and rearrangement of the mounting blocks 80, securing bolts 164 can be inserted from the top, through the mounting blocks 80 and into the support 44.

Figure 11:
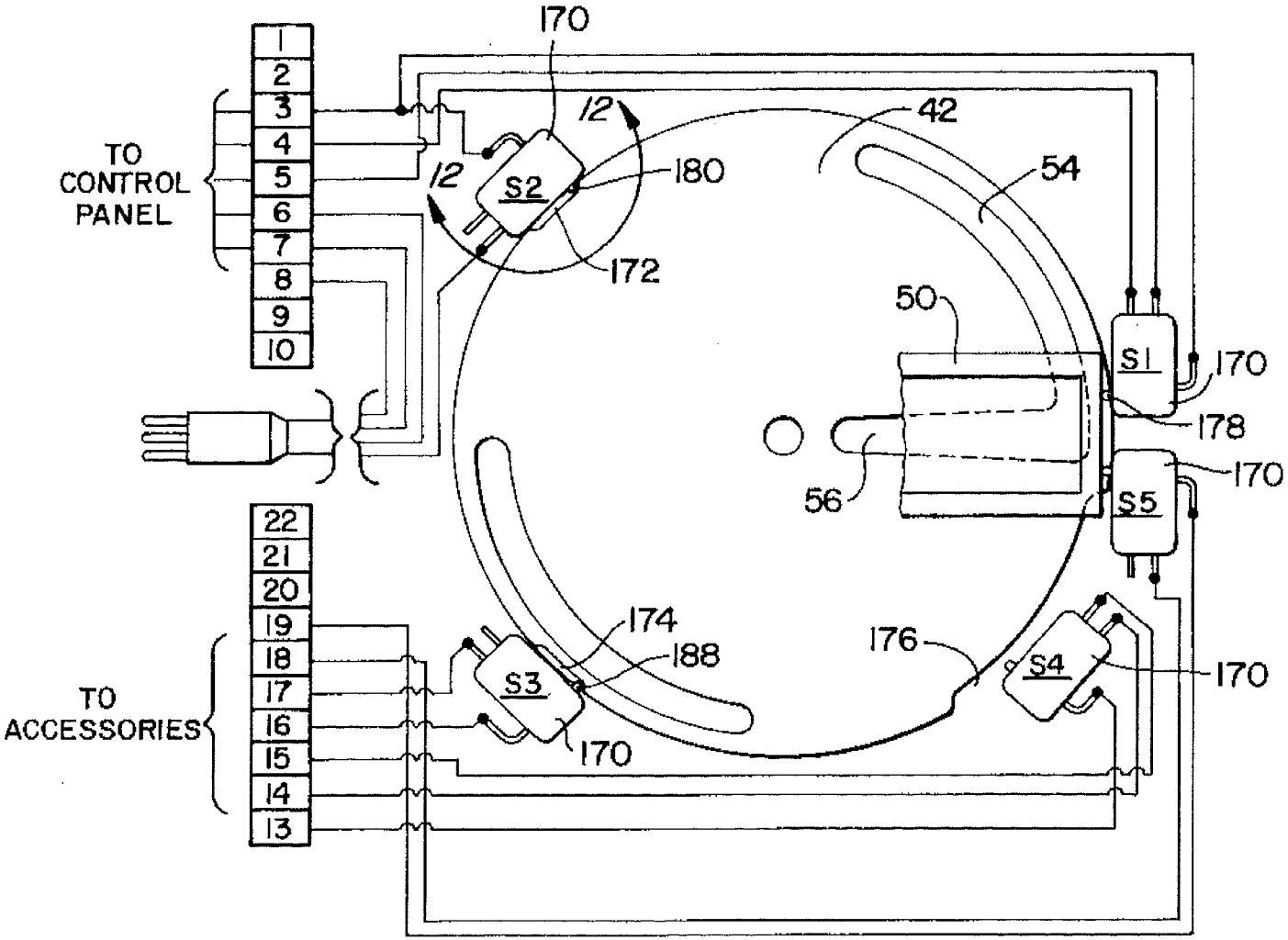
FIG. 11 is a top plan view of a preferred switch system for use with the trolling valve safety device of the invention.

Referring to FIG. 11, the device 10 can also provide a system for actuating a variety of switches 170 to control different alarms, indicator lights, actuators, safety and limit switches and other components as a function of trolling valve or throttle condition. According to the invention, the condition of the trolling valve or the engine throttle can be coordinated with various switches by their relative position to control slots on the periphery of the control plate 42.

A first switch S1 can be mounted relative to the support to position the switch actuator 178 for engagement with the cam slider 50. The switch S1 is wired in conventional manner to activate the red and green indicator lamps of the control panel to advise of the condition of the trolling valve. When the cam slider 50 is positioned away from the switch actuator 178, corresponding to travel in the radial lock slot and activation of the trolling valve, the switch actuator 178 is released, and the red indicator is illuminated. Conversely, when the cam slider 50 travels out of the radial slot 56 and is aligned with the arcuate slot 54, permitting throttling, the switch actuator 178 is depressed and causes the green indicator lamp to be illuminated.

A second switch S2 can be provided to prevent the electromechanical actuator from attempting to move the cam slider 50 when the cam member is not aligned with the radial slot 56. If this attempted actuation is not prevented, mechanical locking can occur and rotation of the control plate 42 can become difficult.

To coordinate the actuation of the switch S2 with the position of the cam slider 50 and cam member relative to the radial slot 56 of the control plate 42, the control plate 42 can provide a control step 172 along the perimeter of the plate 42. The actuator 180 of the switch S2 is extended into the step 172 when the cam member is aligned with the radial slot, thereby permitting activation of the electromechanical actuator to move the cam member in and out of the radial slot 56.

When the control plate 42 is rotated such that the cam member is positioned in the arcuate slot 54 and disaligned from the radial slot 56, the actuator 180 of the switch S2 is moved out of the step 172 and is depressed by the edge of the control plate 42. The depressed actuator 172 prevents circuit completion to the electromechanical actuator and inadvertent movement of the cam slider 50.

Figure 13:
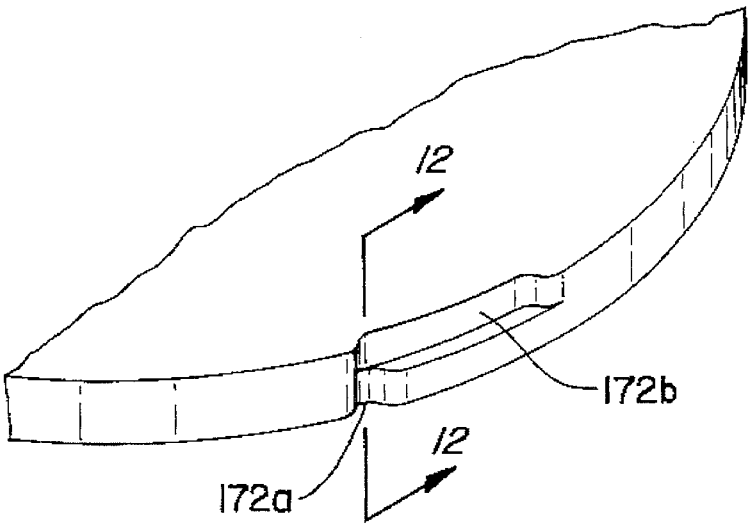
FIG. 13 is a segmented perspective view of a control plate for the trolling valve safety device, illustrating a multilevel control step for alternative actuation configurations relative to an engaging switch, as shown in FIGS. 12 and 12*a;*
Figure 12:
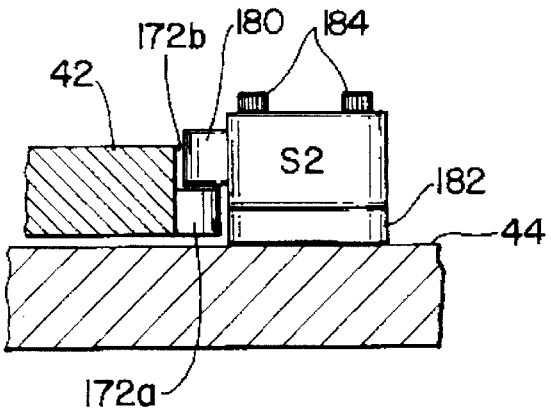
FIGS. 12 and 12*a* are sectional view of a control plate and cooperating switch for use with the trolling valve safety device, illustrating alternative configurations for the switch.
Figure 12A:
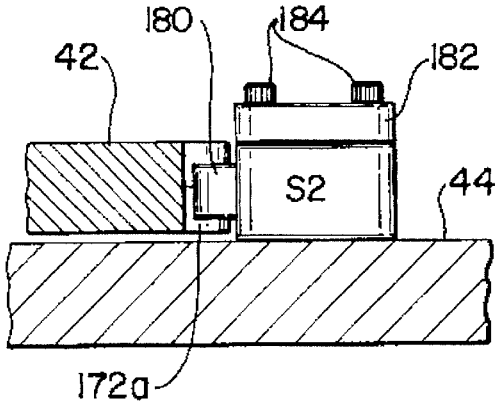

Referring to FIGS. 12 and 12*a*, the second switch S2 can positioned at different heights, through use of a vertical spacer 182, to align the switch actuator 180 with different step configurations. The different step configurations 172*a* and 172*b*, as illustrated in FIG. 13, correspond to the switch ranges for the variable and non-variable lock conditions of the control plate 42 as determined by the location of the stop pin 112, as discussed above in connection with FIGS. 3–5.

In the higher position of step 172*b* shown in FIG. 12, the switch actuator 180 is aligned with the longer step 172*b* corresponding to the range of throttling play permitted by the stop pin 112 in the variable speed position. Throughout the range of variable play, the switch actuator 180 is extended and permits operation of the electromechanical actuator to move the cam slider 50. When the control plate 42 is rotated to place the cam member 50 in the arcuate slot 56, the switch actuator 180 is removed from the elongated step 172B and depressed by the edge of the control plate 42, thereby preventing operation of the electromechanical actuator.

The lower position 172*a* of FIG. 12*a* can be aligned with the switch actuator 180 of the second switch S2 by moving the spacer 182 from the lower position. The spacer 182 can be stored above the switch S2 in this configuration. The switch actuator 180 is then aligned with the notched step 172*a*, as shown clearly in FIG. 13, permitting operation of the electromechanical actuator when the cam slider 50 is aligned with the radial slot 56 and does not permit variable play in the control plate 42 before disengaging operation of the electromechanical actuator. The vertical arrangement of the switch S2 can be readily changed using removable bolts 184.

Various safety systems can be coordinated with the operation of the trolling valve. For example, a transmission oil pressure alarm is typically triggered by a drop in pressure below a predetermined level. The activation of the trolling valve will cause a pressure drop well below this level and activate the alarm. Because it is safe to have this low pressure level during use of a trolling valve, it is desirable to automatically disable the alarm during trolling valve use and reactivate after the trolling valve is closed. Referring again to FIG. 11, a third switch S3 can be provided to switch the alarm off when the switch actuator 188 is extended and activate the alarm when the switch actuator 180 is depressed. The extension and depression for the switch actuator 188 for switch S3 can be controlled identically to that described above for switch S2, including the vertical adjustability for variable and non-variable plate play.

Various safety devices for the engine can be coordinated with the throttle, utilizing the relative positions of the control plate 42. For example, a switch S4 can be positioned among the edge of the control plate 42 to activate an oil pressure alarm during a predetermined range of engine speed. Typically, a primary oil pressure alarm is arranged to be triggered at a relatively low pressure level on the order of 5–10 psi. Unfortunately, at cruising speeds, engine oil pressure demands are higher and damage can occur if the level is not maintained well above this alarm level. Thus, a pressure drop to the 5–10 psi level will trigger the primary alarm too late. It is desirable to have a secondary pressure alarm that is triggered at a predetermined level more closely correlated to the cruising speed of the particular engine. At lower speeds, it is desirable to deactivate the secondary switch to avoid alarms for oil pressure levels that are acceptable for lower speeds.

Because the pressure level for triggering the secondary alarm will vary depending on engine type and user preferences, the switch S4 can be adjustably mounted relative to a control step to activate over a selected speed range. Referring briefly to FIG. 10, the switch S4 can be mounted in different holes 190 on the support 44 to vary the beginning, end and range of the alarm activation relative to the control step 176

Other engine accessories, such as Glendinning synchronizers, can be activated and deactivated relative to the trolling valve condition. Similar to switch S1, a switch S5 can be positioned relative to the cam slider 50 to deactivate the synchronizer when the trolling valve is used, and vice versa. This switch S5 can also be used to mechanically limit electronic throttle controls, such as in a Caterpillar engine system.

Figure 14:
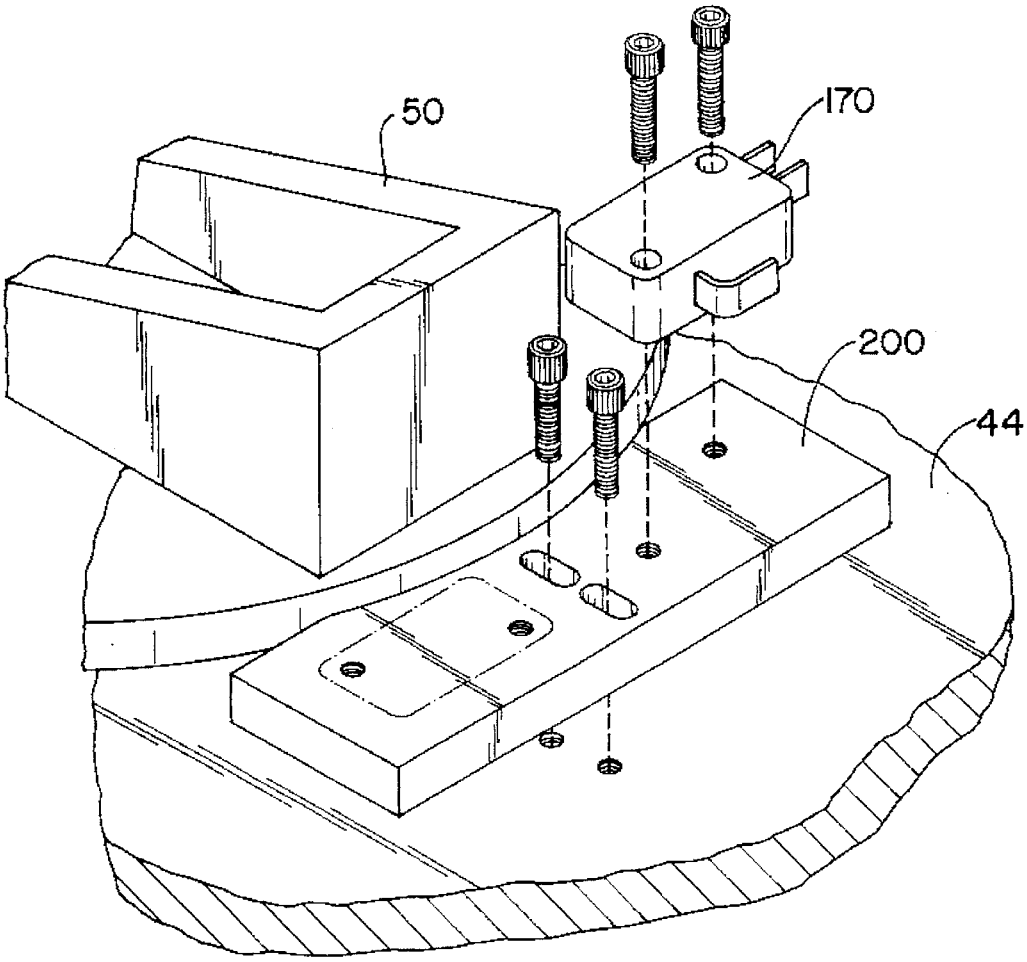
FIG. 14 is a perspective view of a switch mounting system for adjustably securing switches relative to the cam slider of the trolling valve safety device.

Referring to FIG. 14, the limits of the switches S1 and S5 can be controlled by adjusting the spacing of the switch actuators relative to the end location of the cam slider 50. This adjustability can be provided by a base 200 having mounting slots 202 that permit sliding of the base 200 and the switches 170 mounted thereon relative to the cam slider end location.

Figure 15:
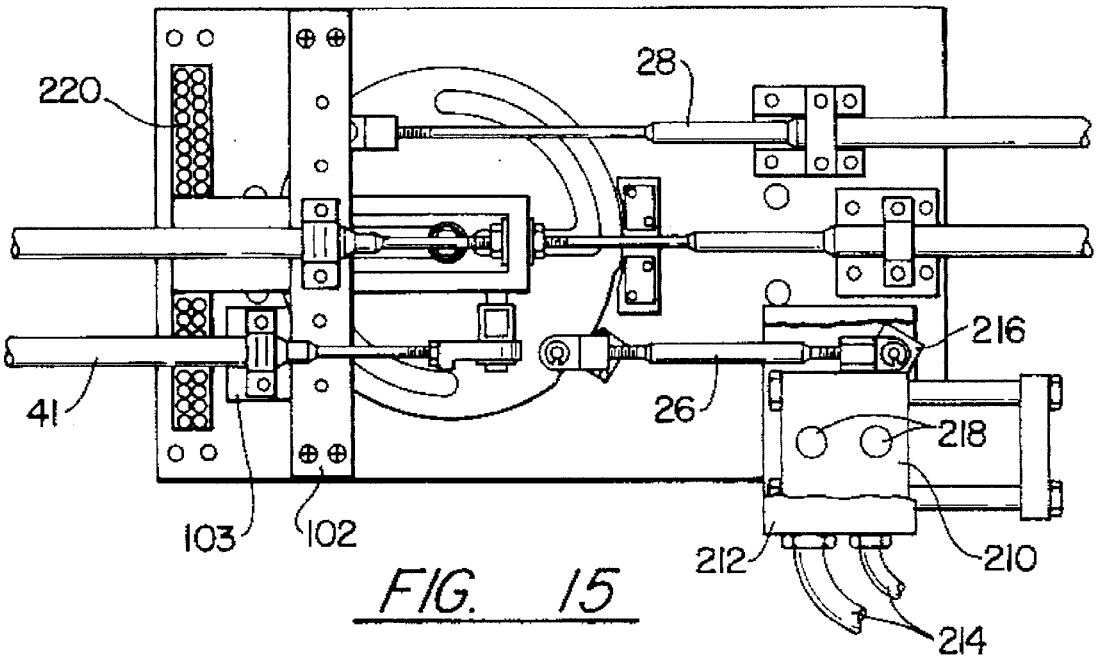
FIG. 15 is a top plan view of an embodiment of the invention equipped with a Hynautic throttle system and mounting bracket therefor as well as a mounting system for a push-to-open trolling valve.

FIG. 15 is a top plan view of an embodiment of the invention equipped with a Hynautic throttle slave actuator 210 and mounting bracket 212 therefor. The Hynautic throttle slave actuator 210 utilizes Hynautic fluid driven through the conduits 214 to control an actuator lever 216. The actuator 216 is connected through a rod 26 to the control plate 42 for throttling as described with respect to the other embodiments above.

The bracket 212 includes a rectilinear case with open sides to permit insertion of the Hynautic housing. The top of the bracket, which is cutaway in the figures, can provide mounting holes that correspond to the mounting holes 218 in the Hynautic housing for securement to the bracket by bolts or similar fasteners. The Hynautic throttle slave actuator 210 can be configured to operate with either push-to-open or pull-to-open throttle by mounting relative to either the control rod 26 or the control cable 28.

FIG. 15 also illustrates a mounting system for a push-to-open trolling valve in which the cable 41 is secured to the bracket 103. This mounting system is preferably used to provide proper cable geometry with a T-handle trolling valve control (not shown). The wiring from the various switches can be directed to a set of terminal blocks 220 that can be numbered for easy connection for adjustments and repairs.

Figure 16:
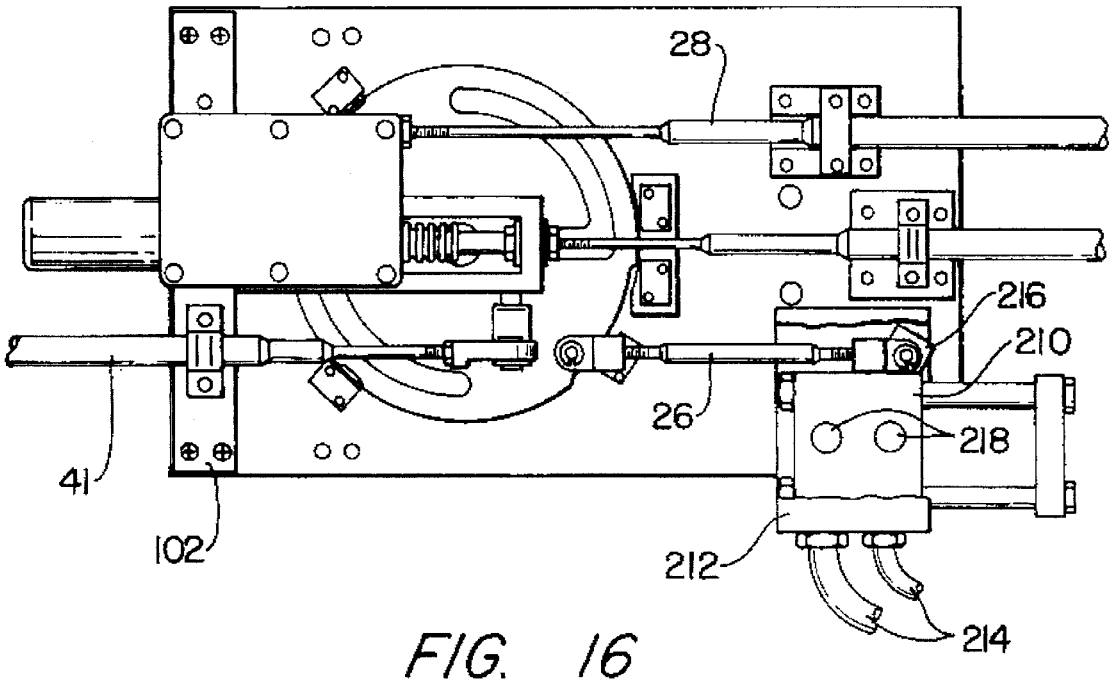
FIG. 16 is a top plan view of an alternative embodiment of the invention equipped with a Hynautic throttle system and mounting bracket therefor as well as another mounting system for a push-to-open trolling valve.

FIG. 16 is a top plan view of an alternative embodiment of the invention equipped with the Hynautic throttle slave actuator 210 and mounting bracket 212 therefor as well as another mounting system for a push-to-open trolling valve in which the trolling valve control cable 41 is attached directly to the mounting bridge 102.

Although preferred embodiments have been described with a relatively high degree of particularity, it is intended that such description will enable those skilled in the art to make and use the invention and not define the scope of the invention. Instead, the scope of the invention should be determined from a reasonable interpretation of the following claims.

I claim:

1. A boat engine trolling valve safety device for limiting changes in the boat engine throttle position during use of a trolling valve on the boat marine transmission, said device comprising:

means for releasably limiting boat throttle actuation to a level no higher than a predetermined burnout threshold for the marine transmission; and means for automatically engaging said limiting means to limit boat throttle actuation when the trolling valve is engaged and automatically releasing the limiting means to release said limit on boat throttle actuation when the trolling valve is disengaged.

2. The safety device according to claim 1, wherein the locking means releasably locks the limiting means in a position corresponding to a limit of the throttle to an idling position of the throttle.

3. The safety device according to claim 1, wherein the locking means is slidable between a locking position in which the limiting means is locked and a releasing position in which the limiting means is released.

4. A boat engine trolling valve safety device for limiting changes in the boat engine throttle position during use of a trolling valve on the boat marine transmission, said device comprising:

means for releasably limiting boat throttle actuation to a level no higher than an engine speed predetermined by the user; and means for automatically engaging said limiting means to limit boat throttle actuation when the trolling valve is engaged and automatically releasing the limiting means to release said limit on boat throttle actuation when the trolling valve is disengaged, said means for automatically engaging said limiting means also automatically limits preventing actuation of the trolling valve when boat throttle actuation exceeds the predetermined engine speed.

5. The safety device according to claim 1, wherein said limiting means prevents actuation of the boat throttle when locked.

6. The safety device according to claim 1, wherein the locking means includes a cam slider and the limiting means includes a control plate rotatable about a central pivot axis, said cam slider having an arcuate channel about the central pivot axis, said cam slider being mounted on the control plate, said control plate having a stop pin extending on the side of the plate to which the cam slider is mounted, wherein the stop pin and the arcuate channel can align to permit rotation of the central plate and the cam slider is slidable to disalign the stop pin and the arcuate channel to thereby limit rotation of the control plate and wherein the plate includes a plurality of mounting positions for the stop pin to permit varying levels of limit of control plate motion when the stop pin is disaligned with the arcuate channel.

7. The safety device according to claim 6, further comprising control members from the group of control rods, control cables, control linkages and Hynautic throttle actuators for actuating the engine throttle, said control members being connected to said control plate so that one of the control members pushes a throttle device for the engine to open the throttle.

8. The safety device according to claim 6, further comprising control members from the group of control rods, control cables, control linkages and Hynautic throttle actuators for actuating the engine throttle, said control members being connected to said control plate so that one of the control members pull a throttle device for the engine to open the throttle.

9. The safety device according to claim 6, further comprising control members from the group of control rods, control cables, control linkages and electromechanically actuated control rods for actuating the trolling valve, said control members being connected to said cam slider so that one of the control members pushes a trolling valve to engage the trolling valve.

10. The safety device according to claim 6, further comprising control members from the group of control rods, control cables, control linkages and electromechanically actuated control rods for actuating the trolling valve, said control members being connected to said cam slider so that one of the control members pulls a trolling valve to engage the trolling valve.

11. An engine system for a boat including:

an engine with a throttle assembly and marine transmission with a trolling valve;

means for releasably limiting actuation of the throttle assembly to a level no higher than a predetermined threshold for burnout of the marine transmission; and means for automatically locking said limiting means to limit actuation of the throttle assembly when the trolling valve is engaged and automatically releasing the limiting means to release the limit on the boat throttle actuation when the trolling valve is disengaged.

12. A boat control safety device for controlling actuation of at least one accessory as a function of use of a trolling valve on the boat marine transmission, said device comprising:

means for controlling actuation of at least one accessory, said controlling means including a plate rotatable about a central axis; and means for automatically limiting rotation of said plate to control actuation of the accessory when the trolling valve is engaged and automatically permitting rotation of the plate to control actuation of the accessory when the trolling valve is disengaged.

13. The safety device according to claim 12, wherein the means for controlling actuation further includes an electrical switch for controlling a signal to the accessory, said electrical switch having a depressible swatch actuator, said switch actuator being positioned adjacent the plate, said plate providing a control depression that is positioned to align and disalign with the switch actuator as a function of a trolling valve operational status.

14. The safety device according to claim 12, wherein the plate provides a plurality of said control depression to permit adjustability to the actuation of the accessory, said safety device further comprising a spacer for adjusting the height of the switch actuator relative to the plate to selectively engage one or the plurality of control depressions.

15. The safety device according to claim 12, wherein the accessory is an alarm.

16. The safety device according to claim 12, wherein the accessory is a Glendinning synchronizer.

17. A boat control safety device for controlling actuation of at least one accessory as a function of use of boat engine throttle, said device comprising:

a plate rotatable about a central axis, said plate being operatively connected to the boat engine throttle and to the throttle control such that the plate rotates as a function of throttle position; and means for controlling actuation of at least one accessory as a function of the plate position, said controlling means including an electrical switch for controlling the actuation of the accessory, said electrical switch having a depressible switch actuator, said switch actuator being positioned adjacent the plate, said plate providing a control depression that is positioned align and disalign with the switch actuator as a function of plate position to coordinate the accessory actuation with the throttle position.

* * * * *